US006045123A

United States Patent [19]

Christen

[11] Patent Number: 6,045,123

[45] Date of Patent: Apr. 4, 2000

[54] SNOWMOBILE TRACK LIFT

[76] Inventor: Mark Charles Christen, Rte. 2, Box 55J, Detroit Lakes, Minn. 56501

[21] Appl. No.: 08/948,404

[22] Filed: Oct. 10, 1997

[51] Int. Cl.[7] ..... B66F 3/00

[52] U.S. Cl. ..... 254/131; 254/134

[58] Field of Search ..... 254/131, 9 R, 254/9 B, 120, 133, 134, 113, 114, 116

[56] References Cited

U.S. PATENT DOCUMENTS

| | | |
|---|---|---|
| 3,907,254 | 9/1975 | Richards . |
| 3,964,729 | 6/1976 | Harlow . |
| 4,420,164 | 12/1983 | Mitchell . |
| 4,457,492 | 7/1984 | Lahti . |
| 4,643,396 | 2/1987 | Beals . |
| 5,143,352 | 9/1992 | Latimer . |
| 5,145,154 | 9/1992 | Bastille et al. . |
| 5,211,265 | 5/1993 | Gregg . |
| 5,441,378 | 8/1995 | Puls . |
| 5,564,683 | 10/1996 | Stuck . |

*Primary Examiner*—Robert C. Watson
*Attorney, Agent, or Firm*—Curtis V. Harr

[57] ABSTRACT

A lifting apparatus which engages and lifts the rear end of a snowmobile and provides a method of locking the snowmobile in an elevated position by the use of a retaining pin. The base of the apparatus consists of a ground engaging frame having a perpendicularly attached and vertically extending section that supports a wide shield. The purpose of this shield is to protect users and bystanders from ice, dirt and snow that is ejected out from under the snowmobile. The lifting mechanism consists of a vertically adjustable snowmobile engaging post. This post is connected to a lifting plate which travels vertically along a center frame member. The plate engages the center frame member with a pair of rollers, one roller in front of the frame member and a second behind. A curved pivot lift bar is attached to the lifting plate and extends upward to a center pivot arm that is pivotally connected to the center frame member. The center pivot arm also has fixedly attached a lift lever. The center pivot arm may be locked against the curved pivot lift bar with a retaining pin, thus holding the lift in an upright position.

11 Claims, 5 Drawing Sheets

10
22
24
34
30
36
42
18
26
46
20
40
38

10
34
24
22
36
38
30
42
26
28
32
20
18
54
40

SNOWMOBILE TRACK LIFT

BACKGROUND OF THE INVENTION

The present invention relates generally to an apparatus for lifting vehicles and more specifically, to an apparatus for lifting the rear of snowmobiles in order to raise the track section above the ground.

Snowmobile use has become a common winter activity, especially in the northern parts of the United States. These vehicles employing a large, treaded belt or track, are driven over snow with directional control facilitated by the use of skis located on the outermost edges underneath the vehicle.

Since most snowmobiles tend to be expensive, proper maintenance is essential to prolong the life of the vehicle. Additionally, because snowmobile use tends to be done in remote, areas, it is essential that the snowmobile be kept in good condition, so it does not breakdown in such an area, leaving the driver stranded. One such maintenance procedure entails lifting the rear end of the snowmobile to allow the drive track to warm up prior to moving over terrain. This procedure is used as an attempt to minimize premature erosion of the drive track and for the removal of ice and other debris as well as the lubrication of the track. Further, as snowmobile tracks are always engaged at higher engine rpms, it is necessary to lift the track in order to warm an engine at higher rpms.

Additionally, occasional repair to the drive track is necessary and adjustments are often made to the engine in order to maximize performance at higher rpms, especially when the snowmobile is used for racing. In either case, the user must lift the back end of the snowmobile to engage the track while keeping the snowmobile stationary. This can be accomplished by employing one or two other people to lift the snowmobile manually, but this is very difficult, dangerous and does not lend itself to time-consuming repairs. Further, if the snowmobile is lifted in order to allow the drive track to warm up, the vehicle must be started, allowing the belt to turn. The turning motion of the belt inevitably causes snow and dirt to be thrown backward, making it difficult and dangerous for the persons holding the vehicle to continue doing so.

U.S. Pat. No. 5,143,352 (issued to Latimer) shows a snowmobile lift apparatus employing the use of a central post mounted to a socket with a simple lever used as the lifting mechanism. Using this device, an individual can lift the end of a snowmobile without assistance. However, once the snowmobile is elevated, the apparatus does not provide a means to keep the snowmobile elevated and the user must employ some type of blocks or hydraulic jack for this purpose. Additionally, this apparatus does not provide a method for retaining debris ejected from the moving tread of the snowmobile and protecting the user, other persons or objects in the vicinity of the snowmobile from such debris.

U.S. Pat. No. 4,643,396 (issued to Beals) shows a tripod stand which employs a lifting lever to elevate a lift rod placed under the back end of the snowmobile. The lever can be locked in a raised position, holding the back end of the snowmobile above the ground. While this apparatus can be used by a single individual to lift the snowmobile, if the drive tread is in motion, snow and other debris can be thrown backward at the user. Again, there is no means by which the user can be protected from this debris.

U.S. Pat. No. 3,964,729 (issued to Harlow) shows a tripod-type device employing a hook, strap and lever apparatus. The hook is placed on the rear end of the snowmobile and is connected to the lever by the strap. When the lever is moved in a downward direction, the rear end of the snowmobile is lifted off the ground. While this apparatus does provide a method for locking the snowmobile in its elevated position, it is cumbersome and does not provide a means for containing the debris ejected from the snowmobile drive tread.

From the foregoing discussion, it can be seen that it would be desirable to provide a method by which an individual can raise the rearward end of a snowmobile and keep it elevated without assistance from another person. Additionally, it would be highly desirable to provide a method which would protect the user and nearby objects from debris thrown backwards from the snowmobile when the drive tread is in motion. Further, it would be desirable to provide a method which is portable, effective and simple in its design and use.

SUMMARY OF THE INVENTION

Therefore, it is the objective of the present invention to provide a method of lifting the rear end of a snowmobile which can be employed by a single person.

It is an additional objective of the present invention to provide a method of lifting a snowmobile which can be locked in place in the lifted position and does not require the use of additional equipment to hold the elevated snowmobile in place.

It is still a further objective of the present invention to provide such a snowmobile lift that is equipped with a shield which restricts the debris ejected by the drive tread and provides protection to the user and other objects in the vicinity from debris.

These objectives are accomplished by use of a lifting apparatus which engages and lifts the rear end of a snowmobile and provides a method of locking the snowmobile in an elevated position by the use of a retaining pin. The base of the apparatus consists of a ground engaging frame having a perpendicularly attached and vertically extending section that supports a wide shield. The purpose of this shield is to protect users and bystanders from ice, dirt and snow that is ejected out from under the snowmobile.

The lifting mechanism of the present invention consists of a vertically adjustable snowmobile engaging post. This post is connected to a lifting plate which travels vertically along a center frame member. The plate engages the center frame member with a pair of rollers, one roller in front of the frame member and a second behind. A curved pivot lift bar is attached to the lifting plate and extends upward to a center pivot arm that is pivotally connected to the center frame member. The center pivot arm also has fixedly attached a lift lever. The center pivot arm may be locked against the curved pivot lift bar with a retaining pin, thus holding the lift in an upright position.

For a better understanding of the present invention, reference should be made to the drawings and the description in which there are illustrated and described preferred embodiments of the present invention.

DESCRIPTION OF THE PREFERRED EMBODIMENT

Figure 1:
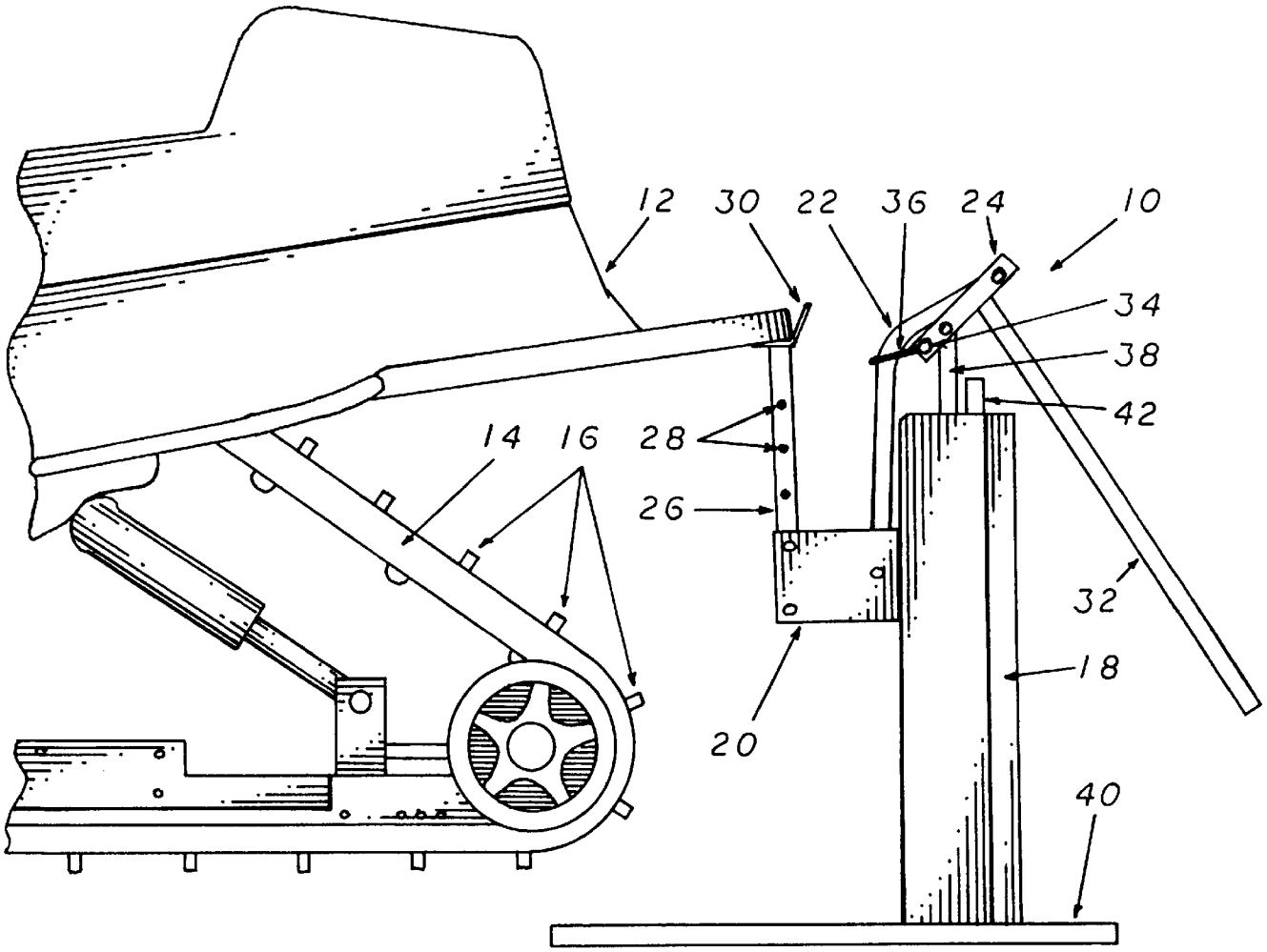
FIG. 1 is a side elevation view of the snowmobile stand showing it as engaged to the rear end of a typical snowmobile and having the track of said snowmobile lifted off of the ground, enabling work to be performed or warm up of the track and engine.
Figure 2:
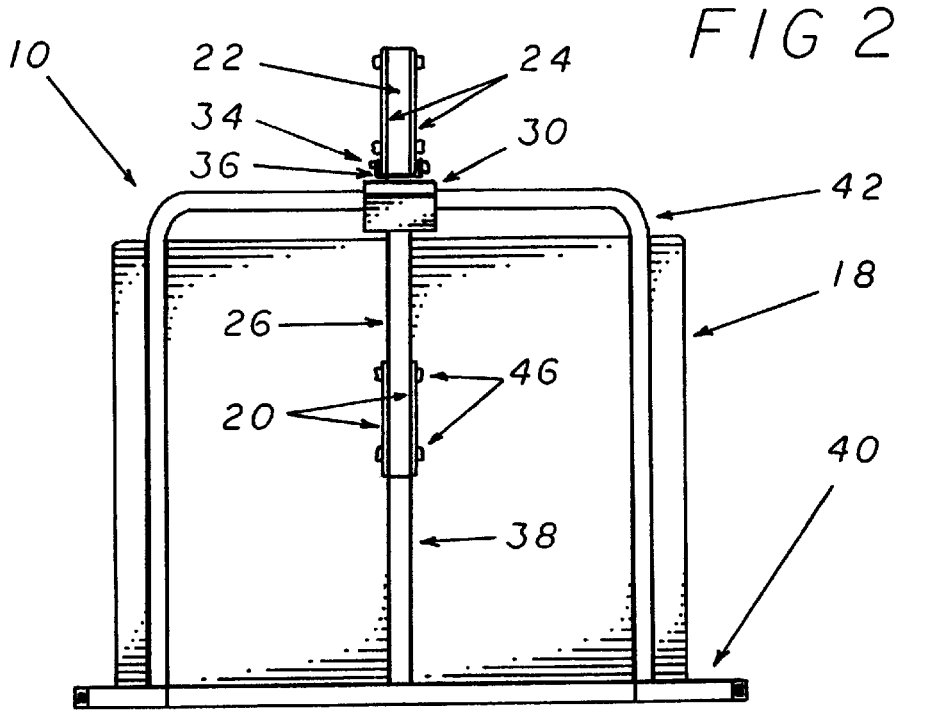
FIG. 2 is a front elevation view of the present invention showing the orientation of its major components, and the manner in which they fit together in said invention.
Figure 3:
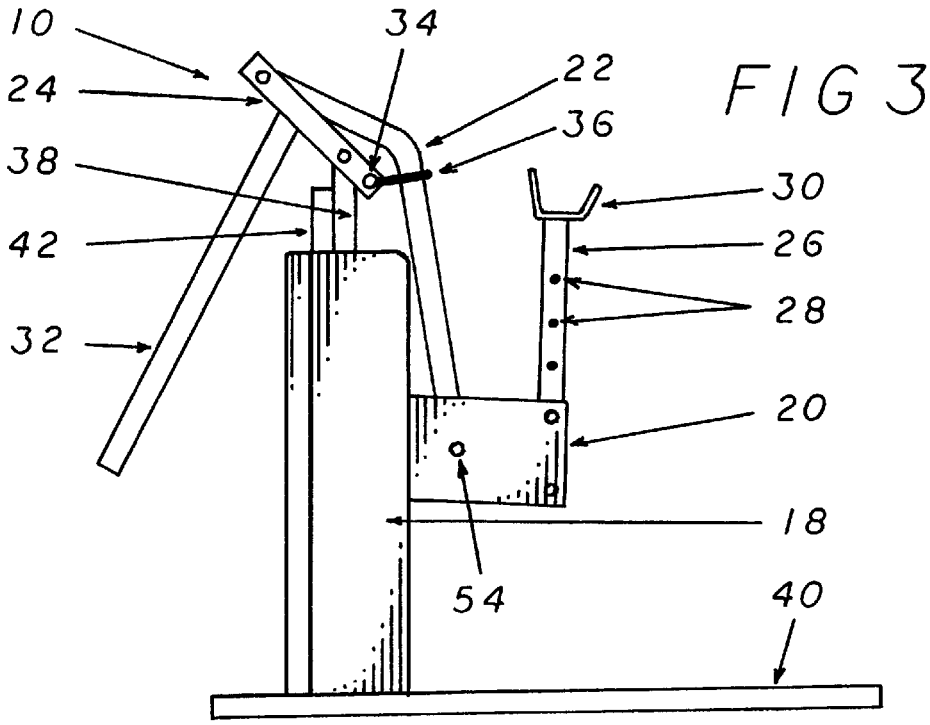
FIG. 3 is a side elevation view of the present invention showing the manner of construction of the lifting apparatus and the frame body of said invention.

Referring now to the drawings, and more specifically to FIGS. 1, 2, and 3, the snowmobile stand 10 is used to lift the rear end of a snowmobile 12 off of the ground when one is working on it. More specifically, the snowmobile lift 10 allows the snowmobile track 14 to be lifted, therefore allowing the snowmobile to be operated fully (e.g. with the track 14 engaged and running as it would be in normal operation), while remaining in a stationary position.

The snowmobile stand 10 lifts the snowmobile 12 by the use of the snowmobile lift cradle 30 which engages and holds the most reward portion of the snowmobile 12. The lift cradle 30 is attached to the most upward end of the variable height lift bar 26 which extends downward to the lift plate 20. The lift plate 20 is the primary lifting mechanism of the present invention and is attached to the center pivot arm 24, which is pivotally attached to the most upward end of the center frame slide member 38, by means of the pivot lift bar 22. The lifting action is accomplished by rotating the lift lever 32 which raises and lowers the pivot lift bar 22, and therefore the lift plate 20, variable height lift bar 26, and lift cradle 30, through the center pivot arm 24. The snowmobile stand 10 is held in the lifting position by the center pivot arm retainer pin 34 and the retainer pin clip 36.

The body of the snowmobile stand 10 comprises a stand base support member 40 which provides the present invention with the necessary lateral support. To this is attached the frame U-member 42 which extends upward from and spans either side of the stand base support member 40. Additionally, the center frame slide member 38 is attached at its lower most end to the stand base support member 40 and near its upper most end to the frame U-member 42. Around the rear surface of the frame is the spray shield 18 which serves as a protective barrier keeping any debris picked up by the track cleats 16 from being thrown beyond the present invention during operation. This design allows the snowmobile track 14 to be run at high speed without the need for being concerned about damaged being caused by such flying debris.

Figure 4:
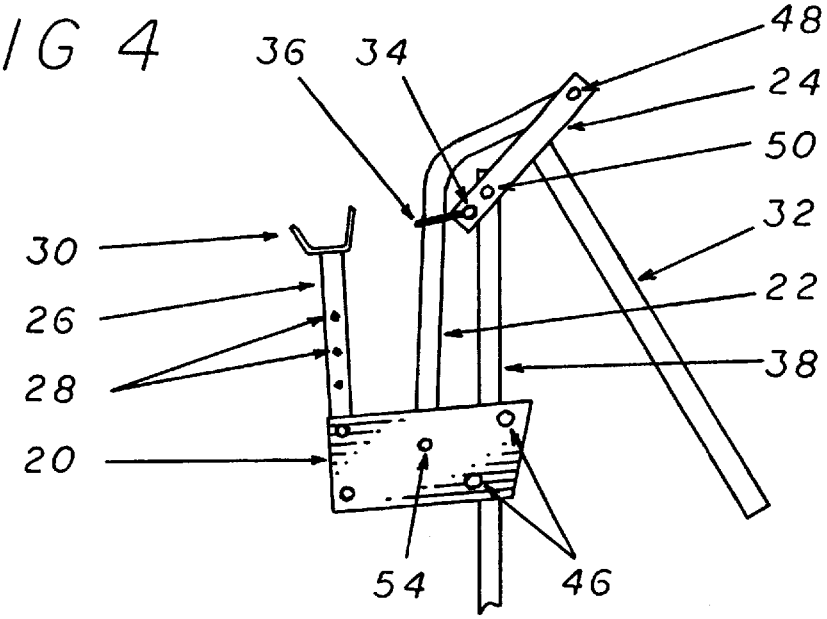
FIG. 4 is a side elevation view of the lifting apparatus of the present invention detailing the construction of said apparatus and the orientation of the major components when it is in the up, or lifted position.
Figure 5:
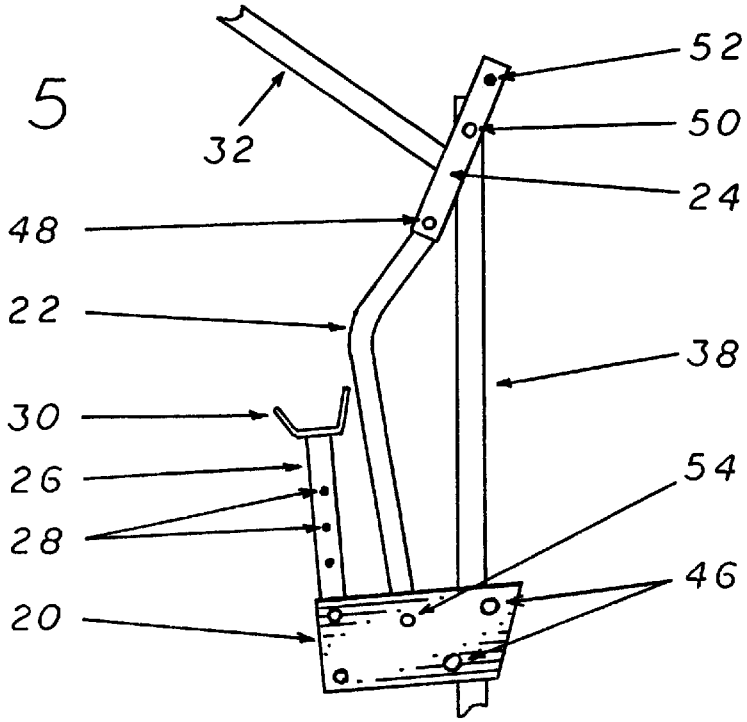
FIG. 5 is a side elevation view of the lifting apparatus of the present invention detailing the construction of said apparatus and the orientation of the major components when it is in the down, or lowered position.

FIGS. 4 and 5 detail the manner in which the present invention operates in raising and lowering the lifting plate 20, and therefore the snowmobile 12. The lifting plate 20 has attached to it at its most forward end, and extending upwards, the variable height lift bar 26. The variable height lift bar 26 is equipped with a plurality of height adapter holes 28 that extend through its body and allow it to be adjusted in relation to its position on the lift plate 20. This configuration allows the height of the lift cradle 30 to be independently adjusted to accommodate the varying heights of snowmobiles 12 on the market today.

The center of the lift plate 20 is equipped with the lift plate pivot attachment 54 which provides a pivotal mount for the pivot lift bar 22. The pivot lift arm 22 attaches to the lift plate 20 at this point, and extends upward to the center pivot arm 24 where it is pivotally attached by means of the pivot lift bar attachment bolt 48. Towards the opposite end of the center pivot arm 24 it is pivotally attached to the center frame slide member 38 by means of the center pivot lift arm attachment bolt 50. At the end opposite, the center pivot arm 24 provides the attachment point for the center pivot arm retainer pin 34 and the retainer pin clip 36 which, when engaged, will not allow the center pivot arm 24 to pivot, thus locking the present invention in the up position. In its central portion, the center pivot arm 24 has attached to it, and extending outward, the lift lever 32 which is used to apply the necessary force to raise and lower the lift plate 20.

Therefore, to lift a snowmobile 12, one removes the retainer pin 34 and retainer pin clip 36 from the center lift arm 24 and forces the lift lever 32 in an upward fashion which, by rotating the center lift arm 24, moves the lift plate 20 and variable position lift bar 26 downward. After engaging a snowmobile 12 with the snowmobile lift cradle 30, one reverses this process and replaces the retainer pin 34 and retainer pin clip 36, thus locking the present invention and the snowmobile 12 in the raised position.

Figure 7:
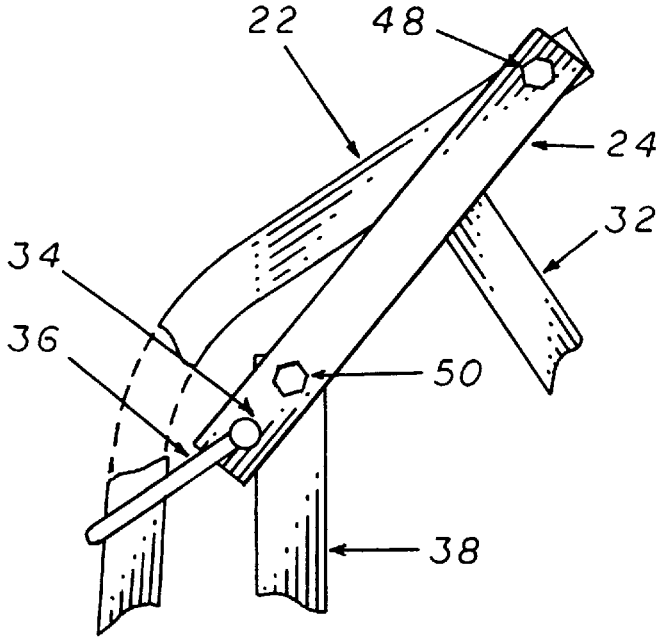
FIG. 7 is a side elevation cut-away view of the locking mechanism of the present invention illustrating the cut-out portion of the previous figure, and detailing the manner of construction and operation of said locking pin. This figure also details the center pivot arm assembly and shows its orientation when the present invention is in the up, or lifted position.
Figure 6:
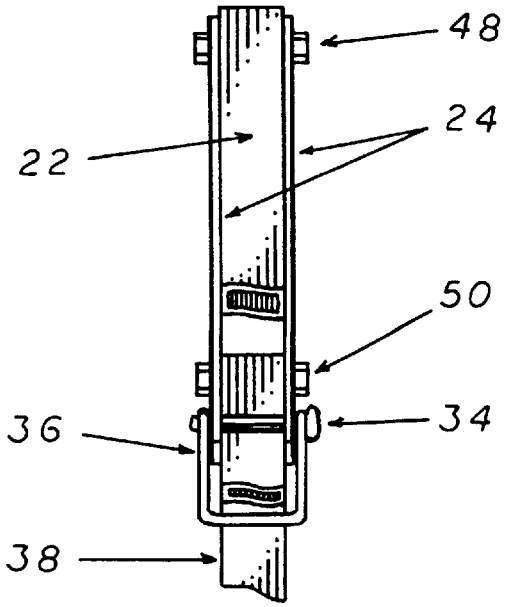
FIG. 6 is a front elevation cut-away view of the locking mechanism of the present invention detailing the manner of construction and operation of said locking pin.
Figure 8:
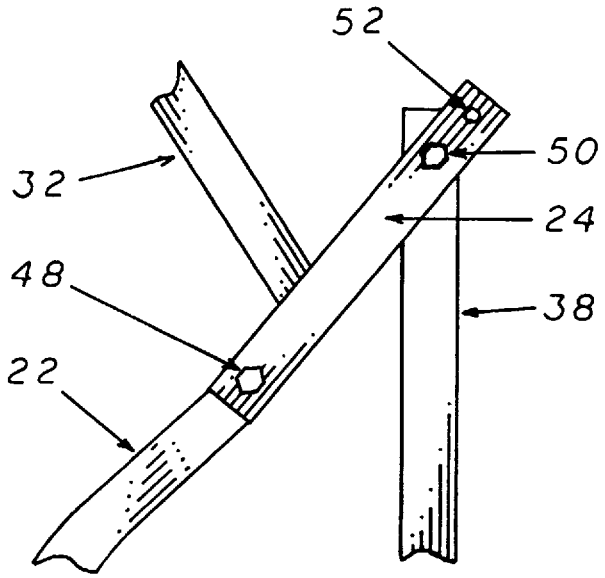
FIG. 8 is a side elevation view of the center pivot arm assembly of the present invention detailing its orientation when said invention is in the down, or lowered position.

FIGS. 6, 7, and 8 detail the manner of construction and the means of operation of the center pivot arm and the retainer pin 34. The retainer pin 34 passes through the two sides of the center pivot arm 24 through the retainer pin attachment holes 52 and, when it is engaged, rests against the upper section of the center frame slide member 38. The retainer pin 34 also has attached to it the retainer pin clip 36 which extends forward and encircles the pivot lift bar 22. The opposite end of the center pivot arm 24 has pivotally attached to it the pivot lift bar 22 (by means of the pivot lift bar attachment bolt 48), which converts the rotation force of the center pivot arm 24 to the vertical force necessary to raise and lower the lift plate 20. Therefore, having the center pivot arm 24 pivotally attached to the center frame slide member 38, by the center pivot lift arm attachment bolt 50, just behind the retainer pin attachment holes 52, enables a configuration in which the center pivot arm 24 is unable to pivot when the retainer pin 34 is in position.

Figure 9:
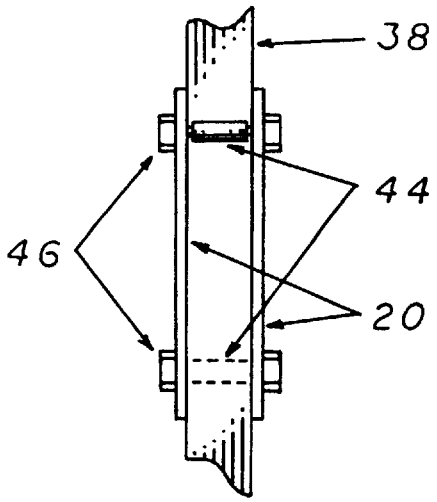
FIG. 9 is a front elevation view of the lift plate assembly of the present invention detailing the manner of construction of the lift plate rollers and their interaction with the frame.

FIG. 9 details the method of construction of the lift plate rollers 44, and the manner in which they engage the center frame slide member 38. The lift plate rollers 44 are held in place by the lift plate roller bolts 46, and are located between the two plates of the lift plate 20, on either side of the center frame slide member 38, which extends through the lift plate 20. Thus, as the lift plate 20 is raised and lowered, this configuration allows it to slide freely along the center frame slide member 38, while keeping it in a stable position along said member.

Although the present invention has been described in considerable detail with reference to certain preferred versions thereof, other versions are possible. Therefore, the spirit and scope of the appended claims should not be limited to the description of the preferred versions contained herein.

What is claimed is:

1. A lifting apparatus especially for raising the rear of a track driven snowmobile so as to lift the track section of the snowmobile off of the ground, said lifting apparatus comprising:

a ground engaging base support member having a front and a rear portion;

a center frame member having a upper end and a lower end, said center frame member extending vertically upward from the rear portion of said base support member;

a lift section, having a front portion, a middle portion and a rear portion, slidably attached to said center frame member at said rear portion;

a snowmobile engaging means extending vertically upward from the front portion of said lift section;

a means of selectively raising and lowering said lift section; and a protective shield extending across the rear portion of the base support member and vertically upward along the center frame member.

2. A lifting apparatus as in claim 1 wherein said means of selectively raising and lowering said lift section comprises:

a curved pivot lift bar having a lower end and a upper end, said curved pivot lift bar pivotally attached to the center portion of said lift section at said lower end and extending vertically upward from said lift section;

a center pivot arm having a front portion, a middle front portion, a middle rear portion and a rear portion, said center pivot arm is pivotally connected at said front portion to said upper portion of said curved pivot lift bar, and pivotally attached at said middle rear portion to the upper portion of said center frame member, said center pivot arm defining a retainer pin attachment hole at the rear portion of said center pivot arm; and a lift lever fixedly attached to said center pivot arm at said middle front portion and extending perpendicularly outward from said center pivot arm.

3. A lifting apparatus as in claim 2 further comprising a retainer pin for locking said lifting apparatus in a raised position by passing through said retainer pin attachment hole when said retainer pin attachment hole is in front of said curved pivot lift bar.

4. A lifting apparatus as in claim 3 wherein said snowmobile engaging means is a vertical post having an upper cradle portion.

5. A lifting apparatus as in claim 4 wherein said vertical post defines a plurality of height adjustment holes for connecting said vertical post to said lift section.

6. A lifting apparatus for raising the rear of a track driven snowmobile so as to lift the track section of the snowmobile off of the ground, said lifting apparatus comprising:

a ground engaging base support member having a front and a rear portion;

a center frame member having a upper end and a lower end, front and back, said center frame member extending vertically upward from the rear portion of said base support member;

a lift plate means, having a front portion, a middle portion and a rear portion, slidably attached to said center frame member at said rear portion;

a snowmobile engaging means extending vertically upward from the front portion of said lift plate means;

a means of selectively raising and lowering said lift plate means; and a shield extending across the rear portion of the base support member and vertically upward along the center frame member.

7. A lifting apparatus as in claim 6 wherein said means of selectively raising and lowering said lift plate means comprises:

a curved pivot lift bar having a lower end and a upper end, said curved pivot lift bar pivotally attached to the center portion of said lift plate means at said lower end and extending vertically upward from said lift plate means;

a center pivot arm having a front portion, a middle front portion, a middle rear portion and a rear portion, said center pivot arm is pivotally connected at said front portion to said upper portion of said curved pivot lift bar and pivotally attached at said middle rear portion to the upper portion of said center frame member, said center pivot arm defining a retainer pin attachment hole at the rear portion of said center pivot arm; and a lift lever fixedly attached to said center pivot arm at said middle front portion and extending perpendicularly outward from said center pivot arm.

8. A lifting apparatus as in claim 7 wherein said lift plate means is attached slidably to said center frame member with a first and second roller, with said first roller engaging the front of said center frame member and said second roller engaging the back of said center frame member.

9. A lifting apparatus as in claim 8 wherein said snowmobile engaging means is a vertical post having an upper cradle portion.

10. A lifting apparatus as in claim 9 wherein said vertical post defines a plurality of height adjustment holes for connecting said vertical post to said lift plate means.

11. A lifting apparatus as in claim 10 further comprising a retainer pin for locking said lifting apparatus in a raised position by passing through said retainer pin attachment hole when said retainer pin attachment hole is in front of said curved pivot lift bar.

* * * * *